US006327863B1

(12) United States Patent
Yamartino et al.

(10) Patent No.: US 6,327,863 B1
(45) Date of Patent: Dec. 11, 2001

(54) CRYOPUMP WITH GATE VALVE CONTROL

(75) Inventors: Stephen J. Yamartino, Wayland; Brett W. Allen, Douglas; Carl H. Geden, N. Attleboro, all of MA (US)

(73) Assignee: Helix Technology Corporation, Mansfield, MA (US)

( * ) Notice: Subject to any disclaimer, the term of this patent is extended or adjusted under 35 U.S.C. 154(b) by 0 days.

(21) Appl. No.: 09/627,579

(22) Filed: Jul. 28, 2000

Related U.S. Application Data

(60) Provisional application No. 60/201,929, filed on May 5, 2000.

(51) Int. Cl.[7] ..... B01D 8/00

(52) U.S. Cl. ..... 62/55.5; 417/901

(58) Field of Search ..... 62/55.5; 417/901

(56) References Cited

U.S. PATENT DOCUMENTS

| | | | |
|---|---|---|---|
| 3,155,310 | 11/1964 | Lorenz . | |
| 4,242,986 | 1/1981 | Bo | 122/33 |
| 4,339,927 | 7/1982 | Sarcia | 62/6 |
| 4,918,930 | 4/1990 | Gaudet et al. | 62/55.5 |
| 5,176,004 | 1/1993 | Gaudet | 62/55.5 |
| 5,259,735 | 11/1993 | Takahashi et al. | 417/203 |
| 5,305,612 | 4/1994 | Higham et al. | 62/55.5 |
| 5,357,760 | 10/1994 | Higham | 62/55.5 |
| 5,375,424 | 12/1994 | Bartlett et al. | 62/55.5 |
| 5,517,823 | 5/1996 | Andeen et al. | 62/55.5 |
| 5,520,002 | 5/1996 | Ishikawa | 62/55.5 |
| 5,582,017 | 12/1996 | Noji et al. | 62/55.5 |
| 5,855,118 | 1/1999 | Lorimer | 62/55.5 |
| 5,862,671 | 1/1999 | Lessard et al. | 62/55.5 |
| 5,901,558 | 5/1999 | Matté et al. | 62/55.5 |
| 5,974,809 | 11/1999 | Wooster et al. | 62/55.5 |

FOREIGN PATENT DOCUMENTS

| | | |
|---|---|---|
| 10-47245 | 2/1998 | (JP) . |
| WO 95/11381 | 4/1995 | (WO) . |

OTHER PUBLICATIONS

Dubois, L.H., "Diffusion Pumped Ultrahigh Vacuum Systems: Important Considerations," *J. Vac. Sci. Technol.* A, 6 (1), Jan./Feb. 1988.

Chu, L.T., et al., "Uptake of HC1 in Water Ice and Nitric Acid Ice Films," *J. Phys. Chem.* 1993, 97, 779–7785.

Kanaya, N., et al., "Vacuum Protection System Using an Interlocked Fast–Closing Valve for a High–Power Wiggler Beam Line," *IEEE Transactions on Nuclear Sci.*, vol. 37, No. 1, Feb. 1990.

(List continued on next page.)

*Primary Examiner*—Ronald Capossela
(74) *Attorney, Agent, or Firm*—Hamilton, Brook, Smith & Reynolds, PC

(57) ABSTRACT

The present invention provides a cryopump coupled to a gate valve in which the gate valve is automatically prevented from being opened during unsafe conditions, for example, when combustible gases such as hydrogen may be present in the cryopump, but may be operated during safe conditions. A method of controlling the gate valve includes automatically determining with a controller whether the cryopump is operating in one of safe and unsafe conditions. The unsafe conditions are situations where combustible gas may be present in the cryopump and may be correlated to parameters of the cryopump including operational modes of the cryopump, and sensed parameters. The gate valve is automatically controlled with the controller based on the determination of safe and unsafe conditions. The gate valve is automatically locked closed during unsafe conditions and remains locked until the unsafe conditions are removed. The gate valve is automatically unlocked after the unsafe conditions change to safe conditions where the gate valve is freely operable.

60 Claims, 4 Drawing Sheets

OTHER PUBLICATIONS

Satow, Y., et al., "Interlock Systems Using Programmable Sequence Controllers and a Monitoring System of the Photon Factory Beamlines," *Rev. Sci. Instrum.* 60 (7), Jul. 1989.

Seedorf, R., "Speicherprogrammierbare Hochvakuum –Pumpstandsteuerung für eine Molekularstrahlapparatur," *Vakuum–Technik*, 37, Jahrgang, Heft Mar. 1988.

Iyer, S., et al., "Molecular Beam Epitaxial System," (Final Report for period Sep. 15, 1993 to Aug. 14, 1995). Dept. of Electrical Engineering North Carolina AT&T State Univ.

Chu, L.T., "Safety Interlock and Remote Computer Monitoring for a Diffusion–Pumped Vacuum System," *J. Vac. Sci. Technol.* A 15 (1), Jan./Feb. 1997.

Mundinger, H.J., et al., "A New Cryopump with a Very Fast Regeneration System," Vacuum, vol. 43, Nos. 5–7, pp. 545–549, (1992).

"Integrated Cryopump Controller", Ebara Technologies Incorporated, No date given.

CRYOPUMP WITH GATE VALVE CONTROL

RELATED APPLICATION

This application claims the benefit of Provisional Application No. 60/201,929 filed May 5, 2000, the entire teachings of which are incorporated herein by reference.

BACKGROUND

Cryopumps are often employed to evacuate gases within process chambers. Typically, a cryopump is coupled to a process chamber by a conduit extending therebetween with a gate valve positioned within the conduit for enabling the cryopump to be isolated from the process chamber. One common situation in which the gate valve is closed to isolate the cryopump from the process chamber is to prevent particular gases or substances introduced into the process chamber from contaminating the cryopump. Another common situation in which the gate valve is closed is during regeneration of the cryopump where the cryopumping surfaces of the cryopump are warmed to release the gases trapped thereon, including hydrogen gas. Failure to close the gate valve during regeneration may allow the released hydrogen gas to enter the process chamber from the cryopump, thereby subjecting the hydrogen gas to the possibility of ignition.

The gate valves in some systems are controlled by a control system which has an interlock for locking the gate valve in particular situations, for example, during regeneration of the cryopump, during power outages, when high levels of particular gases or substances are within the process chamber, etc. Usually, the locked gate valves may be reopened by changing operating modes of the cryopump, or by using reset or override switches. Consequently, such gate valves may be opened during potentially dangerous or unsafe conditions, for example, when hydrogen gas is present within the cryopump. Opening of a gate valve with hydrogen gas present in the cryopump may result in an explosion or fire if the hydrogen gas flows into the process chamber and ignites.

SUMMARY

The present invention provides a cryopump coupled to a gate valve and an electronic controller therefor, where the gate valve is prevented from being opened during unsafe conditions, for example, when combustible gases such as hydrogen may be present in the cryopump, but may be operated during safe conditions when combustible gases are not present. A method of controlling the gate valve includes automatically determining with a controller whether the cryopump is operating in one of safe and unsafe conditions. The unsafe conditions include situations where combustible gas may be present in the cryopump. The safe and unsafe conditions are correlated to parameters of the cryopump including operational modes of the cryopump, and sensed parameters. The gate valve is automatically controlled with the controller based on the determination of safe and unsafe conditions. The gate valve is automatically locked closed during unsafe conditions and remains locked until the unsafe conditions are removed. The gate valve is automatically unlocked after the unsafe conditions change to safe conditions. During safe conditions, the gate valve is freely operable.

In preferred embodiments, such control of the gate valve is accomplished locally wherein the controller is integral with the cryopump. This allows the controller to override other systems controlling the gate valve, for example the overall process system. Consequently, even if the process system specifies that the gate valve is to be opened, the controller will keep the gate valve locked closed if an unsafe condition is present.

During regeneration of the cryopump, purge gas is applied through the cryopump for purging gases, including combustible gases, from the cryopump. An initial predetermined time period is timed with a timer at the start of purging. The controller automatically determines during the initial predetermined time period that the cryopump is in an unsafe condition. If regeneration of the cryopump is aborted during the initial predetermined time period of purging, the controller automatically determines that an unsafe condition continues to exist. Once aborted, if regeneration of the cryopump is restarted and purge gas is applied again for more than the initial predetermined time period, the controller automatically determines that the unsafe condition has changed to a safe condition.

During regeneration, if a sensor in the cryopump senses that a purge gas failure has occurred during the initial predetermined time period, the controller automatically determines that an unsafe condition continues to exist. Once a purge gas failure has occurred, if regeneration is aborted, the purge gas failure remedied, regeneration restarted, and purge gas applied through the cryopump for more than the initial predetermined time period, the controller will automatically determine that the unsafe condition has changed to a safe condition. The initial predetermined time period is at least about 1½ minutes but is preferably about 5 minutes.

If a pumping surface of the cryopump rises in temperature from below 20 K, preferably 18 K, to above 20 K, preferably 22 K, as sensed with a sensor in the cryopump, the controller automatically determines that an unsafe condition exists. If the sensor senses that the temperature then drops back below 20 K, preferably below 18K, the controller automatically determines that the unsafe condition has changed to a safe condition. If the pumping surface remains above 20 K, preferably 22 K, and purge gas is applied through the cryopump for more than the predetermined time period, the controller will automatically determine that the unsafe condition has changed to a safe condition.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
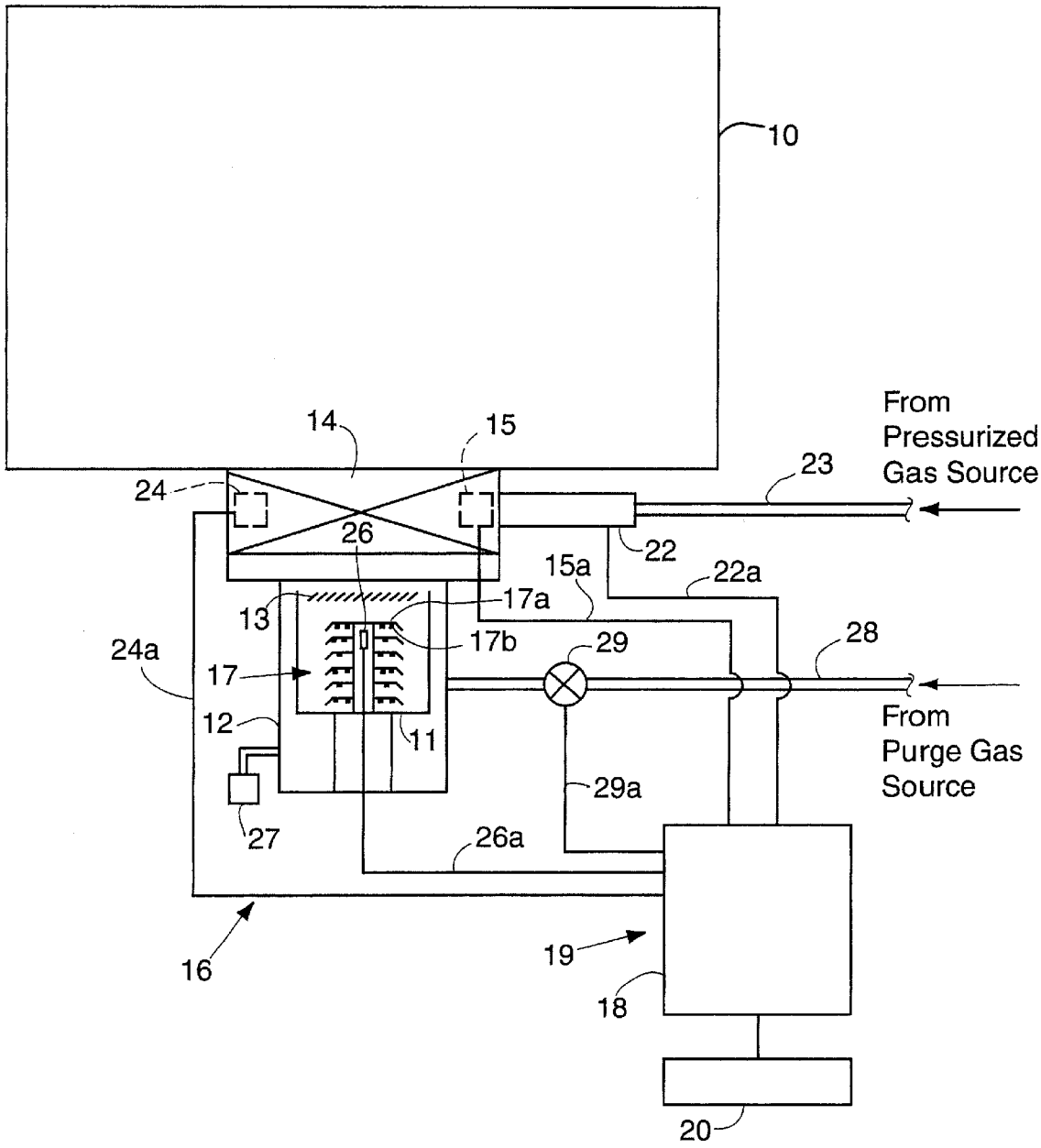
FIG. 1 is a schematic drawing of the present invention cryopump with gate valve control which is coupled to a process chamber.

Referring to FIG. 1, a cryopump system 16 is coupled to a process chamber 10 for evacuating gases from the process chamber 10. Cryopump system 16 includes a cryopump 12 for trapping gases from process chamber 10, a gate valve 14 capable of isolating cryopump 12 from process chamber 10, and a control system 19 for controlling the operation of cryopump 12 and gate valve 14. Cryopump 12 is typically a two stage pump and includes a first stage frontal array 13 having cryopumping surfaces or cryopanels which extend from a radiation shield 11 for condensing high boiling point gases thereon such as water vapor, and a second stage array 17 with cryopumping surfaces or cryopanels 17*a* for condensing low boiling point gases thereon. The cryopanels 17*a* of the second stage array 17 include adsorbent 17*b* for adsorbing very low boiling point gases such as hydrogen. The first stage array 13 typically operates at a temperature in the range of 60 K–130 K and the second stage array 17 typically operates at a temperature in the range of 4 K–16 K. Arrays 13/17 are cooled by a cryogenic refrigerator. Gate valve 14 is positioned between the chamber of the cryopump 12 and process chamber 10. Control system 19 includes a controller 18 which is electrically connected to cryopump 12 and gate valve 14 for controlling the operation of cryopump 12 and gate valve 14. Preferably, the controller 18 is integral with the cryopump as described in U.S. Pat. No. 4,918,930, which is incorporated herein by reference in its entirety. Controller 18 allows gate valve 14 to be opened during conditions designated or determined by controller 18 to be safe while preventing the gate valve 14 from being opened during conditions that are designated by controller 18 as being unsafe where combustible gas such as hydrogen gas may be present in the cryopump 12. During conditions designated as being unsafe, controller 18 locally controls gate valve 14 and prevents gate valve 14 from being opened regardless of whether the overall process program allows the gate valve 14 to be opened. On the other hand, the gate valve 14 need not be opened during safe conditions, the normal process program will then make that determination.

Most commonly, the conditions designated or determined by controller 18 to be unsafe arise during regeneration of cryopump 12 when the pumping surfaces of arrays 13/17 are warmed to release the gases trapped thereon. Before regeneration can be started, gate valve 14 is first closed. Once regeneration begins, controller 18 is programmed to conclude or determine that an unsafe condition exists and automatically locks gate valve 14 to prevent gate valve 14 from being opened. As the pumping surfaces of second stage array 17 warm up, hydrogen gas trapped in the adsorbent 17*b* of the cryopanels 17*a* becomes released. If the gate valve 14 were to be opened when hydrogen gas is present within cryopump 12, the hydrogen gas may flow into the process chamber 10 and be ignited by equipment therein, resulting in an explosion or fire. Normally, during regeneration, the released hydrogen gas is vented from the cryopump 12 at the beginning of regeneration with a warm inert purge gas from a purge gas source (typically nitrogen gas). After 5 minutes of applying the purge gas through the cryopump 12 as timed by a timer within controller 18, controller 18 is programmed to conclude that the hydrogen gas is removed from the interior of the cryopump 12. The controller 18 determines that the status of cryopump 12 has changed from an unsafe condition to a safe condition and unlocks gate valve 14 so that gate valve 14 may be freely opened and closed. Although the hydrogen gas in some systems may be removed in the first 1½–2 minutes of purging, the 5 delay minute setting is employed as a safety factor. If regeneration is aborted or if there is a purge gas failure before a full 5 minutes of purge gas is applied through cryopump 12, then controller 18 is programmed to conclude that an unsafe condition continues to exist and gate valve 14 remains locked. Controller 18 will not allow gate valve 14 to be opened until regeneration is restarted and purge gas has been applied for another 5 minutes so that the unsafe condition changes to a safe condition. Alternatively, applying purge gas for 5 minutes without restarting regeneration will also change the unsafe condition to a safe condition.

During normal operation of cryopump 12, Controller 18 is also programmed to conclude or determine that unsafe conditions occur when the second stage array 17 of cryopump 12 rises in temperature from below 18 K to above 22 K. Typically, hydrogen gas remains trapped within the adsorbent 17*b* on cryopanels 17*a* at temperatures below about 20 K. As temperatures rise above about 25 K, the hydrogen gas begins to be released from the adsorbent 17*b*. By providing controller 18 with the temperature settings of 18 K and 22 K, a safety factor is introduced which accounts for variations in operating temperature and the accuracy of the temperature sensing equipment. As a result, if the second stage array 17 of cryopump 12 rises in temperature to above about 22 K, controller 18 is programmed to determine that an unsafe condition exists and automatically closes gate valve 14 and prevents gate valve 14 from opening. Controller 18 will not allow gate valve 14 to be opened until either the second stage array 17 of cryopump 12 is brought back below 18 K, or purge gas is applied for about 5 minutes. The purge gas may be applied with or without initiating regeneration. Any of these solutions will change the unsafe condition to a safe condition.

Consequently, controller 18 automatically locks gate valve 14 closed only during conditions designated by controller 18 to be unsafe while allowing gate valve 14 to be freely opened and closed as desired during conditions designated by controller 18 to be safe. Such safe conditions includes the period of regeneration after the 5-minute application of purge gas is applied, when the second stage array 17 is at a temperature below 18 K, and after a 5-minute application of purge gas is applied when the temperature of the second stage array 17 rises above 22 K. Controller 18 is able to make conclusions regarding unsafe and safe conditions based upon a function of operational modes as well as sensed and measured parameters, for example, gate position, second stage array 17 temperature, and time. In addition, controller 18 overrides the overall process program to prevent gate valve 14 from being opened in unsafe conditions even if the overall process program allows gate valve 14 to be opened.

Referring to FIG. 1, a more detailed description of one embodiment of cryopump system 16 now follows. Gate valve 14 is opened and closed by pressurized gas supplied by line 23. Typically, the pressurized gas is nitrogen gas from the purge gas source but may, alternatively, be pressurized air. A normally closed spring return solenoid valve 22 is coupled between gate valve 14 and line 23 for directing the pressurized gas to the appropriate ports of gate valve 14 for opening and closing gate valve 14. The controller 18 is electrically connected to solenoid valve 22 by line 22*a* for controlling the operation of solenoid valve 22. Since solenoid valve 22 is normally closed, if a power failure occurs, the spring return of solenoid valve 22 shifts solenoid valve 22 to the position in which the pressurized gas closes gate valve 14. Two limit switches acting as position sensors 15 and 24 are located within gate valve 14 on opposite sides and are employed for detecting whether the gate of gate valve 14 is in the open or closed position. The gate trips position sensor 15 when in the open position and position sensor 24 when in the closed position. Position sensors 15 and 24 are electrically connected to controller 18 by lines 15*a* and 24*a,* respectively, and provide signals to controller 18 indicative of the gate position of gate valve 14. Although limit switches are preferably employed as position sensors 15/24, alternatively, other suitable switches or sensors may be employed, such as proximity switches. A temperature sensor 26 is attached to the second stage of array 17 for monitoring the temperature thereof. Temperature sensor 26 is electrically connected to controller 18 by line 26*a* and provides controller 18 with signals indicative of temperature. Temperature sensor 26 is preferably a thermocouple. A purge gas line 28 extending from the purge gas source is coupled to cryopump 12 for applying purge gas within cryopump 12. Typically, the purge gas source is a pressurized tank of nitrogen gas at room temperature or warmer, but alternatively, may be other suitable inert gases. A purge gas valve 29 along line 28 controls the application of the purge gas into cryopump 12. Purge gas valve 29 is a normally closed spring return solenoid valve that is electrically connected to controller 18 by line 29*a*. An exhaust valve 27 is coupled to cryopump 12 for allowing gases to be vented from cryopump 12. An interface 20 having a keypad and display is electrically connected to controller 18 which allows commands to be entered for controlling cryopump 12 and gate valve 14, as well as for displaying status and error messages.

Figure 2:
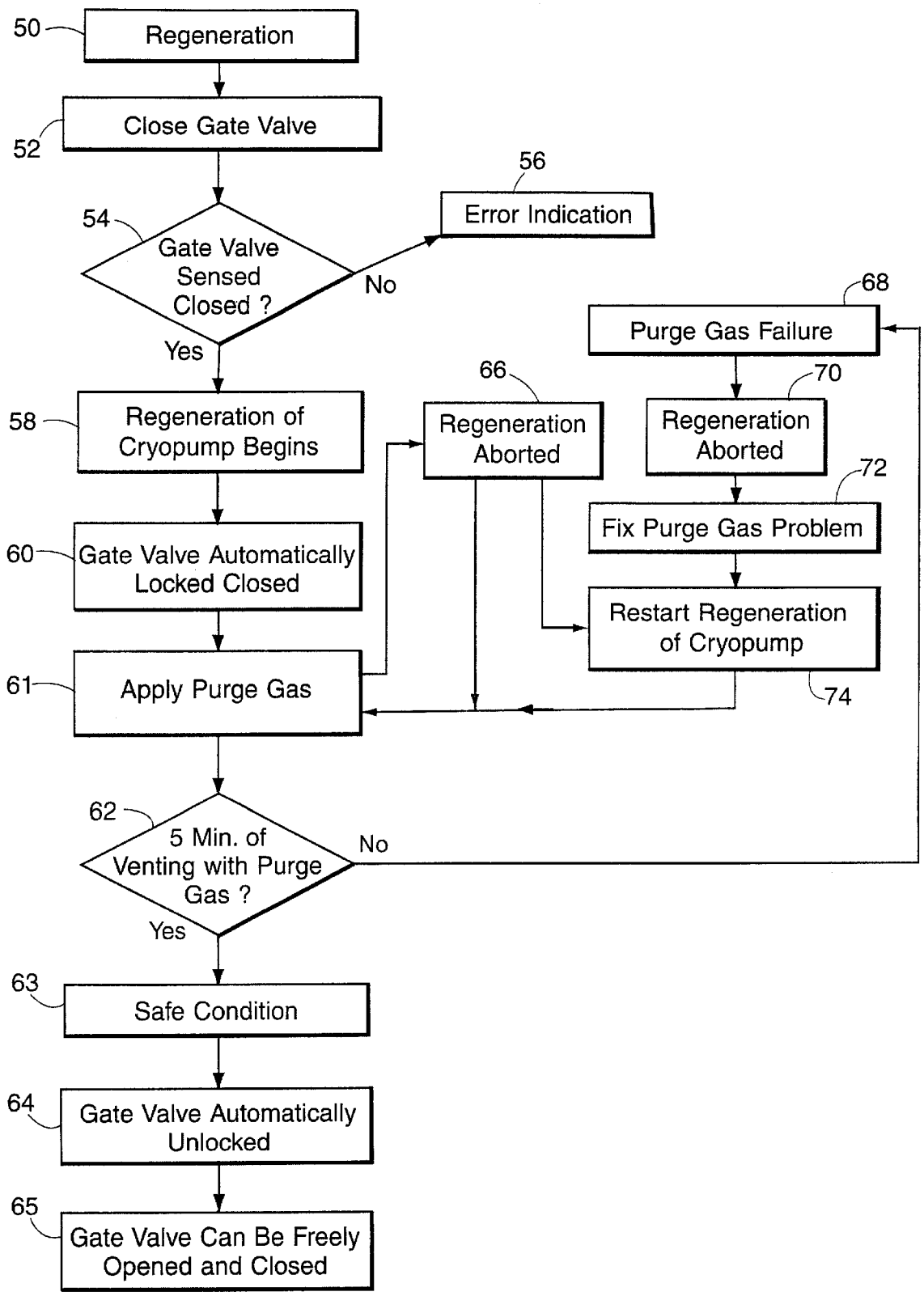
FIG. 2 is a flow chart depicting the control of the gate valve based upon situations arising during regeneration.

Referring to FIG. 2, a discussion of a method of controlling gate valve 14 with controller 18 during regeneration now follows. In step 50, in order to initiate regeneration, gate valve 14 must first be closed in step 52. If gate valve 14 is unable to close and is sensed open by position sensor 15 (decision block 54), then an error indication is provided by interface 20 in step 56 and regeneration will not begin. If position sensor 24 senses that gate valve 14 is closed (decision block 54), regeneration of cryopump 12 begins in step 58. Once regeneration begins, controller 18 concludes or determines that an unsafe condition exists and it automatically locks gate valve 14 closed in step 60 by disabling or inhibiting solenoid valve 22 and preventing operation thereof. Controller 18 opens purge valve 29 in step 61 and allows warm purge gas from the purge gas source via line 28 to flow through the interior of cryopump 12 and out through exhaust valve 27. As the warm purge gas warms the surfaces of the second stage array 17, hydrogen gas begins to release from the adsorbent 17*b* and is vented from cryopump 12 with the purge gas. After timing a 30 second delay, if temperature sensor 26 senses that the second stage array 17 has risen in temperature sufficiently to indicate purge gas is present, controller 18 turns on heaters (not shown) for heating the cryopumping surfaces for more rapid heating. If a 5 minute period of applying purge gas through cryopump 12 is timed (decision block 62), controller 18 is programmed to conclude that the unsafe condition no longer exists (i.e., the hydrogen gas removed) and the cryopump 12 is in a safe condition (step 63). The controller 18 automatically unlocks gate valve 14 in step 64 by enabling operation of solenoid valve 22, thereby allowing gate valve 14 to be freely opened and closed in step 65. Although gate valve 14 may be opened after 5 minutes of purging, the application of purge gas through cryopump 12 still continues for further purging. Depending upon the situation, this can last for another 15–60 minutes. As previously mentioned, most of the hydrogen gas is vented from cryopump 12 in the first 1½–2 minutes of purging. Setting the controller 18 to unlock gate valve 14 after 5 minutes of purging provides a significant safety factor. However, depending upon the situation, it can be seen that the 5 minute setting may be changed to a time period that ranges from 1½–5 minutes, or is greater than 5 minutes.

In a situation where gate valve 14 is automatically locked closed in step 60 with purge gas being applied in step 61, and regeneration is aborted in step 66 without completing 5 minutes of purging cryopump 12 with purge gas, controller 18 is programmed to conclude that an unsafe condition still exists (i.e., hydrogen gas may be in the system) and continues to keep gate valve 14 locked closed by keeping solenoid valve 22 disabled. In order to remove the unsafe condition, regeneration may be restarted in step 74 and purge gas reapplied through cryopump 12 in step 61. If 5 minutes of purging is timed (decision block 62), the controller 18 is programmed to conclude that the unsafe condition has changed to a safe condition (i.e., the hydrogen gas removed) in step 63 and automatically unlocks gate valve 14 in step 64 by enabling operation of solenoid valve 22 so that gate valve 14 may be freely opened and closed in step 65. Alternatively, to change the unsafe condition to a safe condition when regeneration is aborted in step 66, instead of restarting regeneration in step 74, purge gas may be instead applied in step 61 and if 5 minutes of purging is timed (decision block 22), controller 18 changes the unsafe condition to a safe condition (step 63).

In a situation where gate valve 14 is automatically locked closed in step 60 with purge gas being applied in step 61, and 5 minutes of purging does not occur (decision block 62), a purge gas failure is sensed in step 68. Controller 18 is programmed to conclude that an unsafe condition still exists (i.e., hydrogen gas in the system) and continues to keep gate valve 14 locked closed by keeping solenoid valve 22 disabled. The purge gas failure is sensed by monitoring the temperature of the second stage array 17 with temperature sensor 26 during the first 30 seconds of purging. If the temperature of the second stage cryopumping surfaces 17 does not rise enough at the end of a timed 30 second period to indicate purge gas is present, controller 18 is programmed to conclude that a purge gas failure has occurred. In order to remove the unsafe condition, regeneration must be aborted in step 70, the purge gas problem fixed in step 72, regeneration restarted in step 74, and purge gas applied in step 61. If 5 minutes of purging with purge gas is timed (decision block 62), controller 18 concludes that the unsafe condition has changed to a safe condition (i.e., the hydrogen gas removed) in step 63 and automatically unlocks gate 14 in step 64 by enabling operation of solenoid valve 22, thereby allowing gate valve 14 to be freely opened and closed in step 65.

Figure 3:
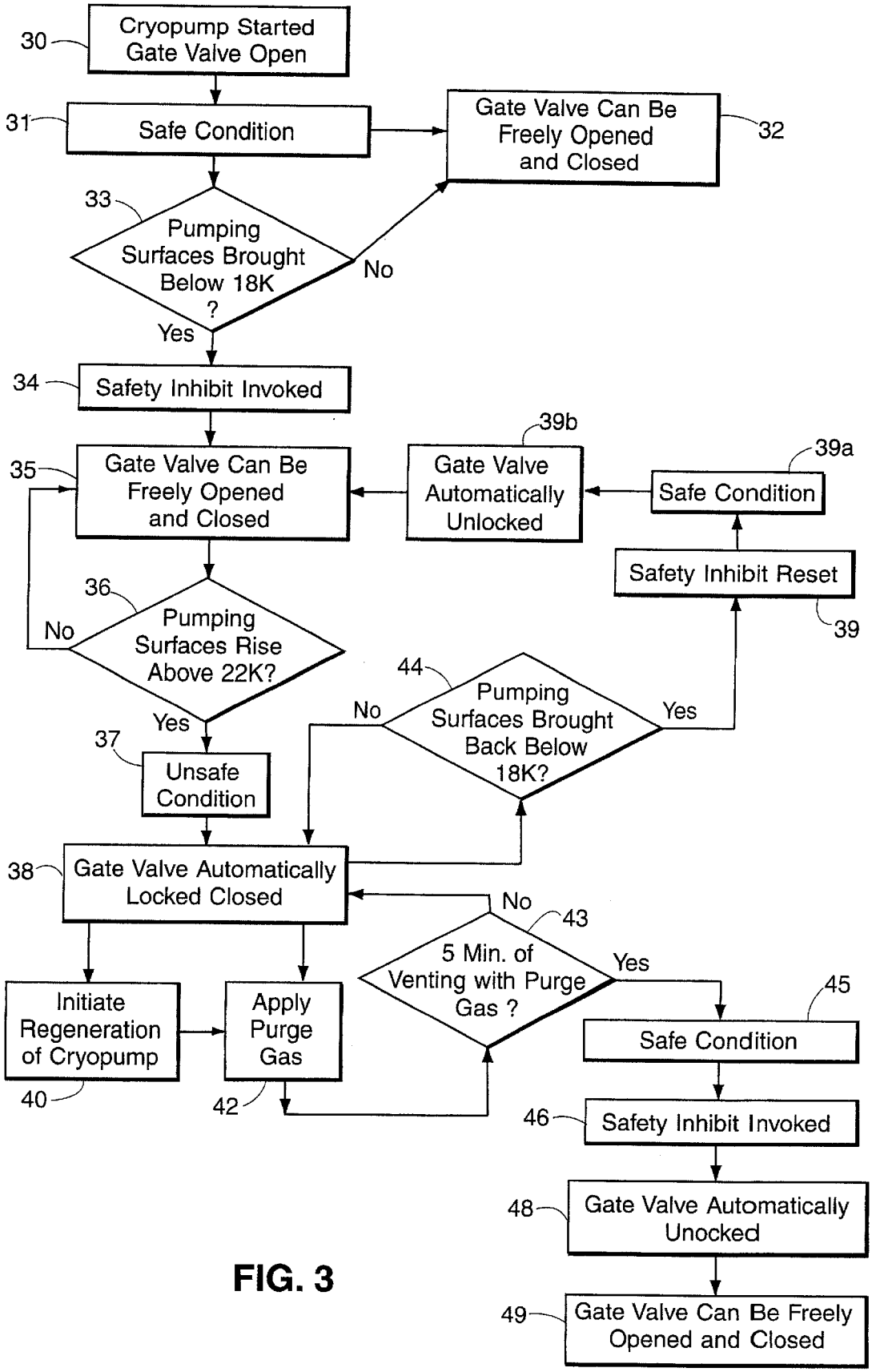
FIG. 3 is a flow chart depicting the control of the gate valve based upon the temperature of cryopumping surfaces withing the cryopump.

Referring to FIG. 3, a discussion of a method of controlling gate valve 14 based upon the temperature of the second stage array 17 now follows. In step 30, cryopump 12 is started and the gate valve 14 is typically opened to evacuate gases from process chamber 10. Controller 18 is programmed to conclude or determine that a safe condition exists in step 31 and allows gate valve 14 to be freely opened and closed in step 32. The cooled cryopumping arrays 13/17 of cryopump 12 draw in gases from the process chamber 10 and trap water vapor on the first stage frontal array 13, low boiling point gases on the second stage cryopanels 17*a,* and very low boiling point gases such as hydrogen in the adsorbent 17*b* of cryopanels 17*a*. While the cryopumping arrays 13/17 cool down and the second stage array 17 has not yet reached a temperature below 18 K as sensed by temperature sensor 26 (decision block 33), the gate valve 14 continues to be freely operated in step 32. Once the second stage array 17 is brought to a temperature below 18 K as sensed by temperature sensor 26 (decision block 33), controller 18 is programmed to conclude that a safe condition still exists since hydrogen gas is trapped in the adsorbent 17*b* of the second stage cryopanels17*a*. However, once the temperature of the second stage array 17 reaches 18 K, a safety inhibit is invoked by controller 18 in step 34. Invoking the safety inhibit at this time merely makes the controller 18 aware that the temperature of the second stage array 17 has reached 18 K so that gate valve 14 may still be freely opened and closed in step 35. Depending upon the processes conducted within process chamber 10, gate valve 14 may be closed at particular instances, for example, to prevent contamination of cryopump 12. The function of the safety inhibit is that if the temperature of the second stage array 17 then rises above 22 K, as sensed by temperature sensor 26 (decision block 36), controller 18 is programmed to conclude in step 37 that an unsafe condition exists in view that hydrogen gas may begin to release from the adsorbent 17*b*. Controller 18 then automatically shifts solenoid valve 22 to cause the pressurized gas within line 23 to close gate valve 14 if gate valve 14 is open and disables or inhibits operation of solenoid valve 22 to keep gate valve 14 locked in step 38. If the gate valve 14 is already closed, controller 18 merely disables operation of solenoid valve 22 to keep gate valve 14 locked closed. Alternatively, if the temperature of the second stage array 17 does not rise from 18 K to 22 K (decision block 36), the gate valve 14 may continue to be freely operated in step 35.

While at step 38, the unsafe condition existing due to the temperature of the second stage array 17 being above 22 K may be changed to a safe condition by bringing the second stage array 17 back down to a temperature below 18 K, as sensed by temperature sensor 26, so that any released hydrogen gas becomes trapped again in the adsorbent 17*b* of the second stage array 17. In decision block 44, if the temperature falls below 18 K again, the safety inhibit is reset or reinvoked in step 39 and controller 18 is programmed to conclude that the unsafe condition has then changed to a safe condition in step 39*a*. Controller 18 automatically enables operation of solenoid valve 22, thereby unlocking the gate valve 14 in step 39*b* so that the gate valve 14 may be freely opened and closed in step 35. Alternatively, if the temperature of the second stage array 17 is not brought back below 18 K (decision block 36), the gate valve 14 remains locked closed in step 38.

A second way of changing the unsafe condition existing at step 38 to a safe condition may be accomplished by applying purge gas through the interior of cryopump 12 for 5 minutes in step 42 to remove the hydrogen gas from cryopump 12. If 5 minutes of purging is timed (decision block 43), controller 18 is programmed to conclude that the unsafe condition has changed to a safe condition in step 45, removes the safety inhibit in step 46 and enables operation of solenoid valve 22 which automatically unlocks gate valve 14 in step 48, thereby allowing the gate valve 14 to be freely opened and closed in step 49. Alternatively, if 5 minutes of purging is not completed (decision block 43), gate valve 14 remains locked closed in step 38.

A third way of changing the unsafe condition existing at step 38 to a safe condition may be accomplished by initiating regeneration of cryopump 12 in step 40 to remove the gases trapped in cryopump 12 and applying purge gas in step 42. If purge gas is applied through cryopump 12 for 5 minutes (decision block 43), controller 18 is programmed to conclude that the unsafe condition has changed to a safe condition in step 45, removes the safety inhibit in step 46 and enables operation of solenoid valve 22 which automatically unlocks the gate valve 14 in step 48, thereby allowing the gate valve 14 to be freely opened and closed in step 49. As previously mentioned, if 5 minutes of purging is not completed (decision block 43), gate valve 14 remains locked closed in step 38.

Although controller 18 has been described to designate temperatures of the second stage array 17 below 18 K as being a safe condition and temperatures of above 22 K as being an unsafe condition, these particular temperature set points have been chosen to provide a safety factor. For example, small levels of hydrogen gas may begin to release from the adsorbent 17*b* when the second stage array 17 reaches a temperature of about 25 K, but significant levels of hydrogen gas do not become released from the adsorbent 17*b* until the second stage array 17 reaches a temperature of about 35 K. By setting the upper limit of a safe temperature at 22 K, a safety factor is provided so that the gate valve 14 closes before significant amounts of hydrogen gas become released. In addition, the second stage array 17 of cryopump 12 normally operates at a temperature of about 4 K to 16 K. By setting the temperature at which the safety inhibit is invoked at 18 K (step 34 in FIG. 3), variations in operating temperatures and temperature measurement accuracy is permitted. Conceivably, the temperature at which the safety inhibit is invoked may be set at temperatures 20 K and below, and the upper limit of a safe condition set at 20 K–34 K.

If the second stage array 17 is sensed by temperature sensor 26 to reach a temperature of 35 K and above, then regeneration of cryopump 12 automatically is initiated regardless of whether or not gate valve 14 can be closed, although attempts are made to close gate valve 14. In addition, when there is a power failure, solenoid valve 22 becomes de-energized and the spring return within solenoid valve 22 shifts the solenoid valve 22 to the position for allowing the pressurized gas to close gate valve 14. When power is resumed, the cryopump 12 may be regenerated or cooled below 18 K as depicted in FIGS. 2 and 3 and described above.

Figure 4:
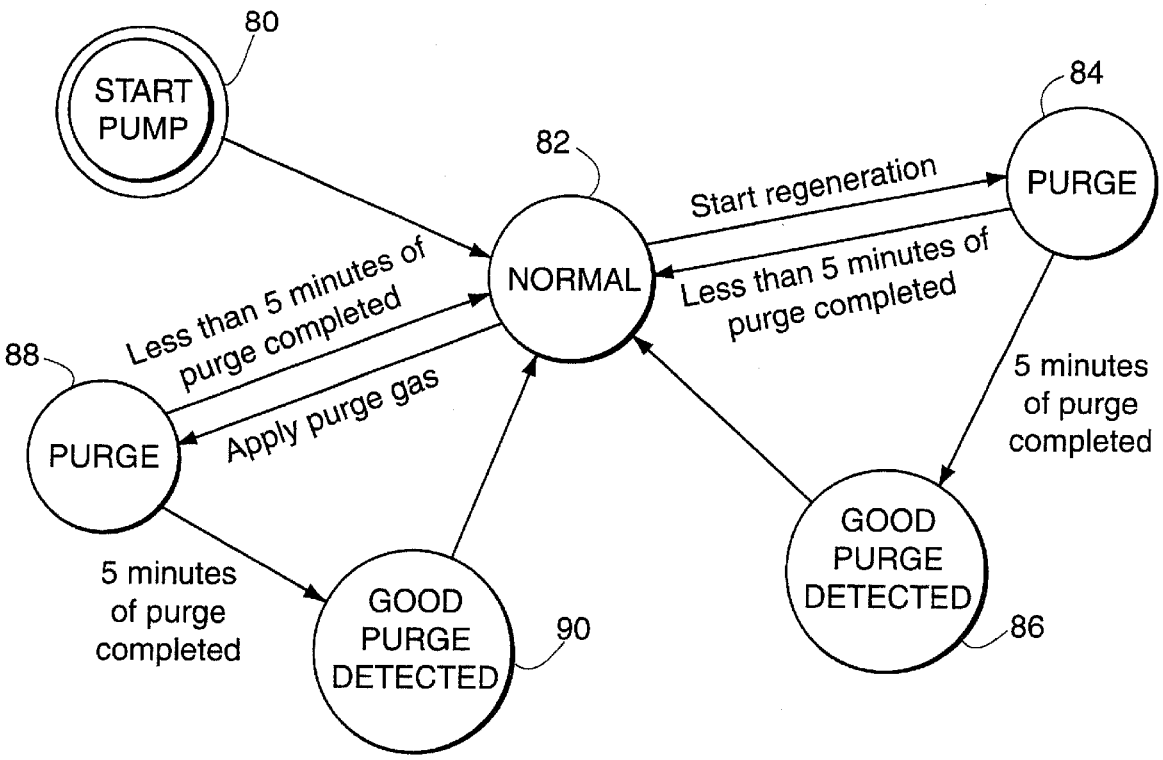
FIG. 4 is a state diagram depicting states of the controller of the cryopump relating to the application of purge gas.

The state diagram of FIG. 4 depicts the states which controller 18 moves between when purge gas is applied to cryopump 12. Controller 18 starts cryopump 12 while in the start pump state 80, and then makes a state transition to the normal state 82 as cryopump 12 begins to operate. Under normal operating conditions, gate valve 14 may be opened and closed. After normal operation, if regeneration is desired, gate valve 14 is first closed. When regeneration is initiated, a shift to the purge state 84 occurs where gate valve 14 is locked closed due to an unsafe condition. If 5 minutes of purge gas is not detected, an unsafe condition is determined to continue to exist and a transition back to state 82 is made and gate valve 14 is kept locked. However, if 5 minutes of purge gas is detected, a shift from the purge state 84 to the good purge detected state 86 is made and a safe condition is determined to exist so that gate valve 14 is automatically unlocked. A transition from state 86 to state 82 is made wherein cryopump 12 may operate in a safe condition and gate valve 14 may be opened and closed.

If an unsafe condition exists while at state 82 (for example, the second stage array 17 rises above 22 K), gate valve 14 is automatically locked closed as previously described with respect to FIG. 3. In such a situation, purge gas may be applied to cryopump 12 without initiating regeneration, and a transition to the purge state 88 occurs where gate valve 14 is kept closed. If 5 minutes of purge gas through cryopump 12 is not detected, an unsafe condition is determined to continue to exist and a transition from state 88 back to state 82 is made with gate valve 14 kept locked. However, if 5 minutes of purge gas is detected, a transition from the purge state 88 to the good purge detected state 90 is made and a safe condition is determined to exist so that gate valve 14 is automatically unlocked. A shift from state 90 to state 82 is then made wherein cryopump 12 may operate in a safe condition and gate valve 14 may be opened and closed. Purge gas may also be applied to cryopump 12 at state 88 when a safe condition exists. In such a situation, gate valve 14 must first be closed.

Figure 5:
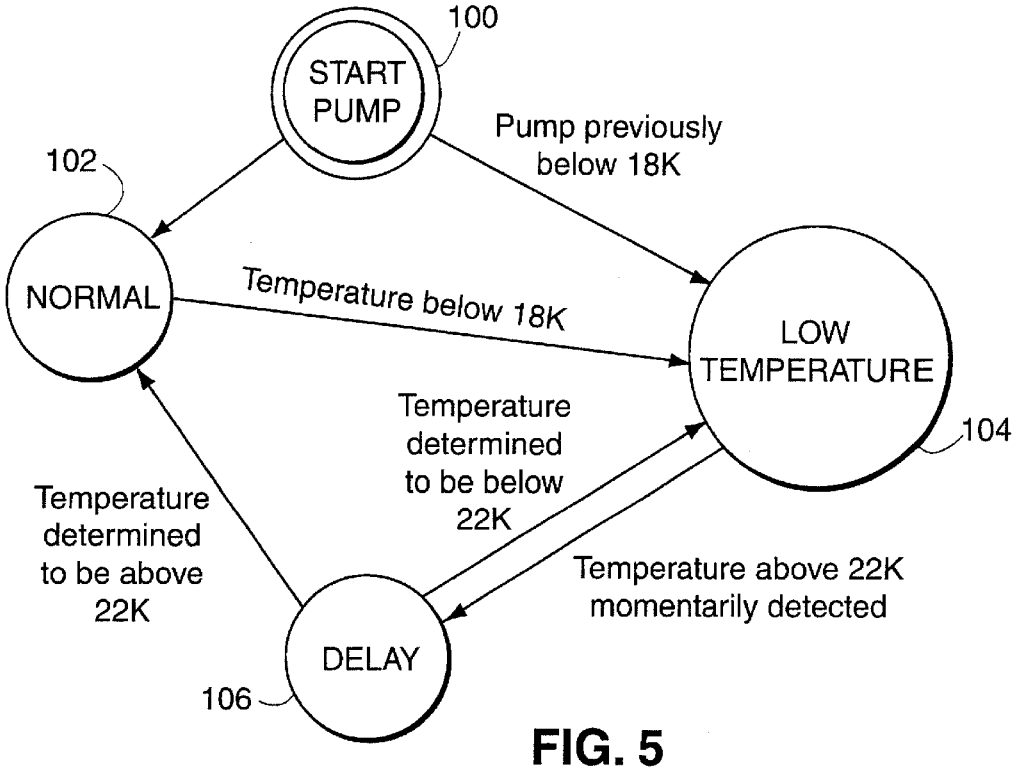
FIG. 5 is a state diagram depicting states of the controller of the cryopump relating to the temperature of cryopumping surfaces within the cryopump.

The state diagram of FIG. 5 depicts the states which controller 18 moves between based on the temperature of the second stage array 17. Controller 18 starts cryopump 12 while in the start pump state 100. A shift to the normal state 102 occurs as cryopump 12 begins to operate. As the second stage array 17 begins to cool, gate valve 14 may be opened and closed. If the temperature of the second stage array 17 is detected to fall below 18 K, a transition from state 102 to the low temperature state 104 occurs wherein the safety inhibit is invoked. Gate valve 14 may still be opened and closed while at state 104. Both states 102 and 104 may correspond with state 82 of FIG. 4. A transition from state 100 to state 104 will also occur if the second stage array 17 was previously below 18 K when cryopump 12 is started up. While at state 104, if the second stage array 17 is momentarily detected to rise above a temperature of 22 K, a transition to the delay state 106 is made. A delay for preferably about 3 seconds occurs at state 106 in which additional temperature readings are made to ensure that the temperature reading was correct. If the subsequent temperature readings made during the delay are below 22 K, a transition from state 106 back to state 104 is made. However, if the subsequent temperature readings during the delay at state 106 confirm that the temperature has risen above 22 K, an unsafe condition is determined to exist and a transition from state 106 to state 102 is made and gate valve 14 is automatically locked closed. Once gate valve 14 is locked closed at state 102, gate valve 14 may be opened by bringing the temperature of the second stage array 17 below 18 K and moving back to state 104. Gate valve 14 may also be opened after applying purge gas for 5 minutes as shown in FIG. 4 where state 102 (FIG. 5) would correspond with state 82 in FIG. 4.

While this invention has been particularly shown and described with references to preferred embodiments thereof, it will be understood by those skilled in the art that various changes in form and details may be made therein without departing from the scope of the invention encompassed by the appended claims.

For example, although particular temperature and time settings have been described, it is understood that these settings include a safety factor so that the temperature and time settings may be varied depending upon the situation at hand. In addition, although FIG. 1 depicts a particular cryopump configuration, the present invention is not limited to such a cryopump but is intended to include other suitable designs. Furthermore, although gate valve 14 has been described to lock primarily when combustible gases such as hydrogen may be in cryopump 12, alternatively, particular systems may have situations in addition to the unsafe conditions described above where gate valve 14 becomes locked closed which may include situations that are not related to safety.

What is claimed is:

1. A method of automatically controlling a gate valve that is coupled to a cryopump, the method comprising the steps of:

automatically determining with a controller whether the cryopump is operating in one of safe and unsafe conditions, the unsafe conditions being situations where combustible gas may be present in the cryopump, the safe and unsafe conditions being correlated to parameters of the cryopump comprising operational modes of the cryopump, and sensed parameters; and automatically controlling the gate valve with the controller based on the determination of safe and unsafe conditions, the gate valve being automatically locked closed during unsafe conditions and remaining locked until the unsafe conditions are removed, the gate valve being automatically unlocked after the unsafe conditions change to safe conditions, the gate valve being freely operable during safe conditions.

2. The method of claim 1 further comprising the step of applying purge gas through the cryopump for an initial predetermined time period for changing an unsafe condition to a safe condition.

3. The method of claim 1 further comprising the step of regenerating the cryopump, wherein purge gas is applied through the cryopump for purging gases from the cryopump including combustible gases.

4. The method of claim 3 further comprising the steps of:

timing with a timer an initial predetermined time period at the start of purging; and automatically determining with the controller that the cryopump during said initial predetermined time period is in an unsafe condition.

5. The method of claim 4 further comprising the steps of:

aborting regeneration of the cryopump during said initial predetermined time period of purging; and automatically determining with the controller that an unsafe condition continues to exist.

6. The method of claim 5 further comprising the steps of:

restarting regeneration of the cryopump and applying purge gas for more than said initial predetermined time period; and automatically determining with the controller that the unsafe condition has changed to a safe condition.

7. The method of claim 6 further comprising the step of defining that said initial predetermined time period is at least about 1½ minutes.

8. The method of claim 7 further comprising the step of defining that said initial predetermined time period is about 5 minutes.

9. The method of claim 4 further comprising the steps of:

sensing a purge gas failure with a sensor during said initial predetermined time period; and automatically determining with the controller that an unsafe condition continues to exist.

10. The method of claim 9 further comprising the steps of:

aborting regeneration, remedying the purge gas failure, restarting regeneration, and applying purge gas through the cryopump for more than said initial predetermined time period; and automatically determining with the controller that the unsafe condition has changed to a safe condition.

11. The method of claim 10 further comprising the step of defining that said initial predetermined time period is at least about 1½ minutes.

12. The method of claim 11 further comprising the step of defining that said initial predetermined time period is about 5 minutes.

13. The method of claim 12 further comprising the steps of:

applying purge gas for more than a predetermined time period through the cryopump in which an unsafe condition exists for said predetermined time period; and automatically determining with the controller that the unsafe condition has changed to a safe condition.

14. The method of claim 13 further comprising the step of defining that said initial predetermined time period is at least about 1½ minutes.

15. The method of claim 14 further comprising the step of defining that said initial predetermined time period is about 5 minutes.

16. The method of claim 1 in which pumping surfaces of the cryopump have risen above a threshold temperature, thereby resulting in an unsafe condition, the method further comprising the step of cooling the pumping surfaces below the threshold temperature for changing the unsafe condition to a safe condition.

17. The method of claim 1 further comprising the steps of:

sensing a temperature rise of a pumping surface of the cryopump with a sensor from a temperature below 20 K to a temperature above 20 K; and automatically determining with the controller that an unsafe condition exists.

18. The method of claim 17 further comprising the steps of:

sensing a temperature drop of the pumping surface with the sensor from above 20 K back below 20 K; and automatically determining with the controller that the unsafe condition has changed to a safe condition.

19. The method of claim 17 in which the temperature below 20 K is 18 K and the temperature above 20 K is 22 K.

20. The method of claim 1 further comprising the steps of:

sensing a temperature rise of a pumping surface of the cryopump with a sensor from a temperature below 18 K to a temperature above 22 K; and automatically determining with the controller that an unsafe condition exists.

21. The method of claim 20 further comprising the steps of:

sensing a temperature drop of the pumping surface with the sensor from above 22 K back below 18 K; and automatically determining with the controller that the unsafe condition has changed to a safe condition.

22. The method of claim 1 further comprising the step of overriding other systems controlling the gate valve to prevent the gate valve from being opened during unsafe conditions.

23. A method of automatically controlling a gate valve that is coupled to a cryopump, the method comprising the steps of:

regenerating the cryopump, wherein purge gas is applied through the cryopump for purging gases from the cryopump;

automatically determining with a controller whether the cryopump is operating in one of safe and unsafe conditions, the unsafe conditions being situations where combustible gas may be present in the cryopump, the safe and unsafe conditions being correlated to parameters of the cryopump comprising operational modes of the cryopump, and length of time that purge gas is applied; and automatically controlling the gate valve with the controller based on the determination of safe and unsafe conditions, the gate valve being automatically locked closed during unsafe conditions and remaining locked until the unsafe conditions are removed, the gate valve being automatically unlocked after the unsafe conditions change to safe conditions, the gate valve being freely operable during safe conditions.

24. The method of claim 23 further comprising the step of applying the purge gas through the cryopump for an initial predetermined time period for changing an unsafe condition to a safe condition.

25. The method of claim 23 further comprising the steps of:

timing an initial predetermined time period at the start of purging with a timer; and automatically determining with the controller that the cryopump during said initial predetermined time period is in an unsafe condition.

26. The method of claim 25 further comprising the steps of:

aborting regeneration of the cryopump during said initial predetermined time period of purging; and automatically determining with the controller that an unsafe condition continues to exist.

27. The method of claim 26 further comprising the steps of:

restarting regeneration of the cryopump and applying purge gas for more than said initial predetermined time period; and automatically determining with the controller that the unsafe condition has changed to a safe condition.

28. The method of claim 27 further comprising the step of defining that said initial predetermined time period is at least about 1½ minutes.

29. The method of claim 28 further comprising the step of defining that said initial predetermined time period is about 5 minutes.

30. The method of claim 25 further comprising the steps of:

sensing a purge gas failure with a sensor during said initial predetermined time period; and automatically determining with the controller that an unsafe condition continues to exist.

31. The method of claim 30 further comprising the steps of:

aborting regeneration, remedying the purge gas failure, restarting regeneration, and applying purge gas through the cryopump for more than said initial predetermined time period; and automatically determining with the controller that the unsafe condition has changed to a safe condition.

32. The method of claim 31 further comprising the step of defining that said initial predetermined time period is at least about 1½ minutes.

33. The method of claim 32 further comprising the step of defining that said initial predetermined time period is about 5 minutes.

34. The method of claim 23 further comprising the step of overriding other systems controlling the gate valve to prevent the gate valve from being opened during unsafe conditions.

35. A method of automatically controlling a gate valve that is coupled to a cryopump, the method comprising the steps of:

automatically determining with a controller whether the cryopump is operating in one of safe and unsafe conditions, the unsafe conditions being situations where combustible gas may be present in the cryopump, the safe and unsafe conditions being correlated to parameters of the cryopump comprising operational modes of the cryopump, and temperature of pumping surfaces of the cryopump; and automatically controlling the gate valve with the controller based on the determination of safe and unsafe conditions, the gate valve being automatically locked closed during unsafe conditions and remaining locked until the unsafe conditions are removed, the gate valve being automatically unlocked after the unsafe conditions change to safe conditions, the gate valve being freely operable during safe conditions.

36. The method of claim 35 in which pumping surfaces of the cryopump have risen above a threshold temperature, thereby resulting in an unsafe condition, the method further comprising the step of cooling the pumping surfaces below the threshold temperature for changing the unsafe condition to a safe condition.

37. A method of claim 35 further comprising the steps of:

sensing a temperature rise of a pumping surface of the cryopump with a sensor from a temperature below 20 K to a temperature above 20 K; and automatically determining with the controller that an unsafe condition exists.

38. The method of claim 37 further comprising the steps of:

sensing a temperature drop of the pumping surface with the sensor from above 20 K back below 20 K; and automatically determining with the controller that the unsafe condition has changed to a safe condition.

39. The method of claim 37 in which the temperature below 20 K is 18 K and the temperature above 20 K is 22 K.

40. The method of claim 38 further comprising the steps of:

applying purge gas for more than a predetermined time period through the cryopump, an unsafe condition existing for said predetermined time period; and automatically determining with the controller that the unsafe condition has changed to a safe condition.

41. The method of claim 40 further comprising the step of defining that said initial predetermined time period is at least about 1½ minutes.

42. The method of claim 41 further comprising the step of defining that said initial predetermined time period is about 5 minutes.

43. The method of claim 35 further comprising the steps of:

sensing a temperature rise of a pumping surface of the cryopump with a sensor from a temperature below 18 K to a temperature above 22 K; and automatically determining with the controller that an unsafe condition exists.

44. The method of claim 43 further comprising the steps of:

sensing a temperature drop of the pumping surface with the sensor from above 22 K back below 18 K; and automatically determining with the controller that the unsafe condition has changed to a safe condition.

45. The method of claim 35 further comprising the step of overriding other systems controlling the gate valve to prevent the gate valve from being opened during unsafe conditions.

46. A cryopump comprising:

a cryopump chamber having at least first and second pumping surfaces;

a gate valve for coupling the cryopump to a process chamber;

an electronic controller for controlling the gate valve and the temperature of the pumping surfaces, the controller capable of automatically determining whether the cryopump is operating in one of safe and unsafe conditions, the unsafe conditions including situations where combustible gas may be present in the cryopump, the controller correlating the safe and unsafe conditions to parameters of the cryopump including operational modes of the cryopump, and sensed parameters, the gate valve being automatically controlled by the controller based on the determination of safe and unsafe conditions, the gate valve being automatically locked closed during unsafe conditions and remaining locked until the unsafe conditions are removed, the controller overriding any other systems controlling the cryopump.

47. The cryopump of claim 46 further comprising a purge gas valve for applying warm purge gas through the chamber, the application of purge gas through the chamber for an initial predetermined time period for changing an unsafe condition to a safe condition.

48. The cryopump of claim 47 further comprising a timer for timing the initial predetermined time period.

49. The cryopump of claim 47 wherein the controller is programmed to determine that an unsafe condition exists for the initial predetermined time period.

50. The cryopump of claim 46 further comprising a temperature sensor on the second pumping surface for sensing temperatures thereof, the controller capable of automatically determining the existence of safe and unsafe conditions based on temperatures of the second pumping surface.

51. The cryopump of claim 50 wherein the controller is programmed to determine that an unsafe condition exists if the second pumping surface rises above a threshold temperature.

52. The cryopump of claim 50 wherein the controller is programmed to determine that an unsafe condition exists if the second pumping surface rises in temperature from below 18 K to above 22 K.

53. The controller of claim 50 further comprising means for applying warm purge gas through the cryopump for an initial predetermined time period for removing combustible gases and changing an unsafe condition to a safe condition.

54. The controller of claim 53 further comprising a timer for timing the initial predetermined time period.

55. The controller of claim 53 wherein the controller is programmed to determine that an unsafe condition exists for the initial predetermined time period.

56. The controller of claim 50 further comprising means for automatically determining the existence of safe and unsafe conditions based on temperatures of the second pumping surface.

57. The controller of claim 56 wherein the controller is programmed to determine that an unsafe condition exists if a pumping surface of the cryopump rises above a threshold temperature.

58. The controller of claim 56 wherein the controller is programmed to determine that an unsafe condition exists if the pumping surface rises in temperature from below 18 K to above 22 K.

59. An electronic controller for controlling a cryopump coupled to a gate valve comprising:

electronics programmed for controlling operation of the cryopump;

means for determining whether the cryopump is operating in one of safe and unsafe conditions, the safe and unsafe conditions being correlated to parameters of the cryopump including operational modes of the cryopump and sensed parameters; and means for automatically controlling the gate valve based on the determination of safe and unsafe conditions, the gate valve being automatically locked closed during unsafe conditions and remaining locked until the unsafe conditions are removed, the controller overriding any other systems controlling the cryopump.

60. The controller of claim 59 in which the controller provides local control for the cryopump.

* * * * *